US007278422B2

(12) United States Patent
Bodner

(10) Patent No.: US 7,278,422 B2
(45) Date of Patent: Oct. 9, 2007

(54) OPEN-CIRCUIT SELF-CONTAINED UNDERWATER BREATHING APPARATUS

(76) Inventor: Alan-Izhar Bodner, HaMeyasdim 7A, Zichron Yaakov (IL) 30900

( * ) Notice: Subject to any disclaimer, the term of this patent is extended or adjusted under 35 U.S.C. 154(b) by 127 days.

(21) Appl. No.: 10/438,315

(22) Filed: May 15, 2003

(65) Prior Publication Data

US 2004/0003811 A1 Jan. 8, 2004

Related U.S. Application Data

(63) Continuation-in-part of application No. PCT/IB01/02142, filed on Nov. 14, 2001.

(60) Provisional application No. 60/248,249, filed on Nov. 15, 2000.

(51) Int. Cl.
*A61M 15/00* (2006.01)
*A61M 15/02* (2006.01)
*A62B 7/08* (2006.01)

(52) U.S. Cl. ..... 128/202.26; 128/202.25; 422/120

(58) Field of Classification Search ..... 128/202.25, 128/202.26, 201.27, 201.28, 200.25, 205.22, 128/205.24, 201.11; 405/186, 185; 205/633; 422/120; 55/383, 385.2
See application file for complete search history.

(56) References Cited

U.S. PATENT DOCUMENTS 3,228,394 A * 1/1966 Ayres ..... 128/200.25
3,293,851 A * 12/1966 Hulbert et al. ..... 60/669
3,318,306 A * 5/1967 Strauss ..... 128/200.25
3,333,583 A 8/1967 Bodell
3,377,777 A * 4/1968 Isomura ..... 95/178
3,504,669 A * 4/1970 Albert ..... 128/201.27
3,656,276 A 4/1972 Vind
3,690,040 A 9/1972 Halfon
3,692,026 A * 9/1972 Tepper et al. ..... 128/202.26
3,910,780 A * 10/1975 Henley et al. ..... 96/12
4,348,976 A * 9/1982 Gilbert ..... 114/55.51
4,467,742 A * 8/1984 Duboy ..... 114/315
4,609,383 A * 9/1986 Bonaventura et al. ..... 95/46
4,662,904 A 5/1987 Ryzin et al.
5,036,841 A * 8/1991 Hamilton ..... 128/202.26
5,170,739 A * 12/1992 Kobayashi ..... 114/315
5,267,558 A * 12/1993 Haertle et al. ..... 128/202.26
5,365,868 A * 11/1994 Culotta ..... 114/315
6,295,984 B1 * 10/2001 Patel ..... 128/201.27
7,171,964 B2 * 2/2007 Moore et al. ..... 128/202.26

FOREIGN PATENT DOCUMENTS

CA 2030804 A 10/1991

* cited by examiner

*Primary Examiner*—Teena Mitchell
(74) *Attorney, Agent, or Firm*—Browdy and Neimark, PLLC

(57) ABSTRACT

A self-contained open-circuit breathing apparatus for use within a body of water naturally containing dissolved air. The apparatus is adapted to provide breathable air to a diver. The apparatus comprises an inlet means for extracting a quantity of water from the body of water. It further comprises a separator for separating the dissolved air from the quantity of water, thereby obtaining the breathable air. The apparatus further comprises a first outlet means for expelling the separated water back into the body of water, and a second outlet means for removing the breathable air and supplying it for breathing. The air is supplied so as to enable all of it to be expelled back into the body of water after it has been breathed.

52 Claims, 3 Drawing Sheets

OPEN-CIRCUIT SELF-CONTAINED UNDERWATER BREATHING APPARATUS

The present application is a continuation-in-part of parent application No. PCT/IB01/02142, filed Nov. 14, 2001, and claims the benefit of U.S. Provisional Appln. No. 60/248,249, filed Nov. 15, 2000.

FIELD OF THE INVENTION

This invention relates to self-contained underwater breathing apparatus and methods.

BACKGROUND OF THE INVENTION

Among known underwater respiration devices are those that supply air via a conduit from the Earth's atmosphere to a submerged user or, in the case of SCUBA, comprise a portable tank with breathable compressed gases including oxygen. In open-circuit SCUBA systems, the breathed, exhaust gas is discarded in the form of bubbles with each breath. Closed-circuit systems recycle the exhaust gas by adding oxygen to and removing carbon dioxide from exhaled breaths.

U.S. Pat. No. 3,333,583 discloses a closed-circuit underwater respiration device which purifies and recycles a diver's exhaled breath. This purification is achieved by driving the exhaust breath through gas permeable tubes, which are surrounded by a current of seawater. Oxygen dissolved in the seawater then passively diffuses across the tubes into the exhaled breath while carbon dioxide similarly diffuses out. The breath is then supplied to the diver for breathing and the process is repeated indefinitely.

U.S. Pat. No. 3,656,276 discloses a closed-circuit method and apparatus for reoxygenating and removing carbon dioxide from stale, breathed air in an underwater habitat by mixing it with seawater in intimate and agitated contact, and subsequently separating the refreshed air from the seawater.

SUMMARY OF THE INVENTION

The present invention suggests a self-contained breathing apparatus that operates in an open-circuit SCUBA-like manner where the user's exhaled breath is expelled into the body of water in the form of bubbles. However, the apparatus of the present invention differs from conventional SCUBA in that it does not require a portable tank of breathable compressed gases.

The apparatus of the present invention comprises an inlet means for extracting a quantity of water from said body of water, a separator for separating said dissolved air from said quantity of water thereby obtaining said breathable air, a first outlet means for expelling the separated water back into said body of water, and a second outlet means for removing said breathable air from the separator and supplying it for breathing.

The apparatus is for use within any body of water that naturally contains dissolved air and it obtains breathable air directly from the surrounding water in which it is submerged. The body of water may be an ocean, lake, pond, river or any such body having breathing marine life such as fish.

The present invention further suggests a method for providing breathable air from a body of water naturally containing dissolved air comprising the steps of drawing an amount of water from said body of water, separating said dissolved air from the drawn water and thereby obtaining said breathable air, expelling the separated water and supplying the separated air for breathing, and expelling the air back into said body of water after it has been breathed.

An apparatus operating according to the method of the present invention may be relatively light and uncomplicated. It also eliminates the need to carry a set amount of breathing air, one of the primary factors normally limiting the amount of time that can be spent underwater. Also, since in the apparatus of the present invention, the separated air already meets a user's pressure requirements for breathing, the apparatus eliminates the need for a pressure regulator, which is necessary in SCUBA to lower the pressure of the compressed gases in the tank.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF THE INVENTION

Figure 1:
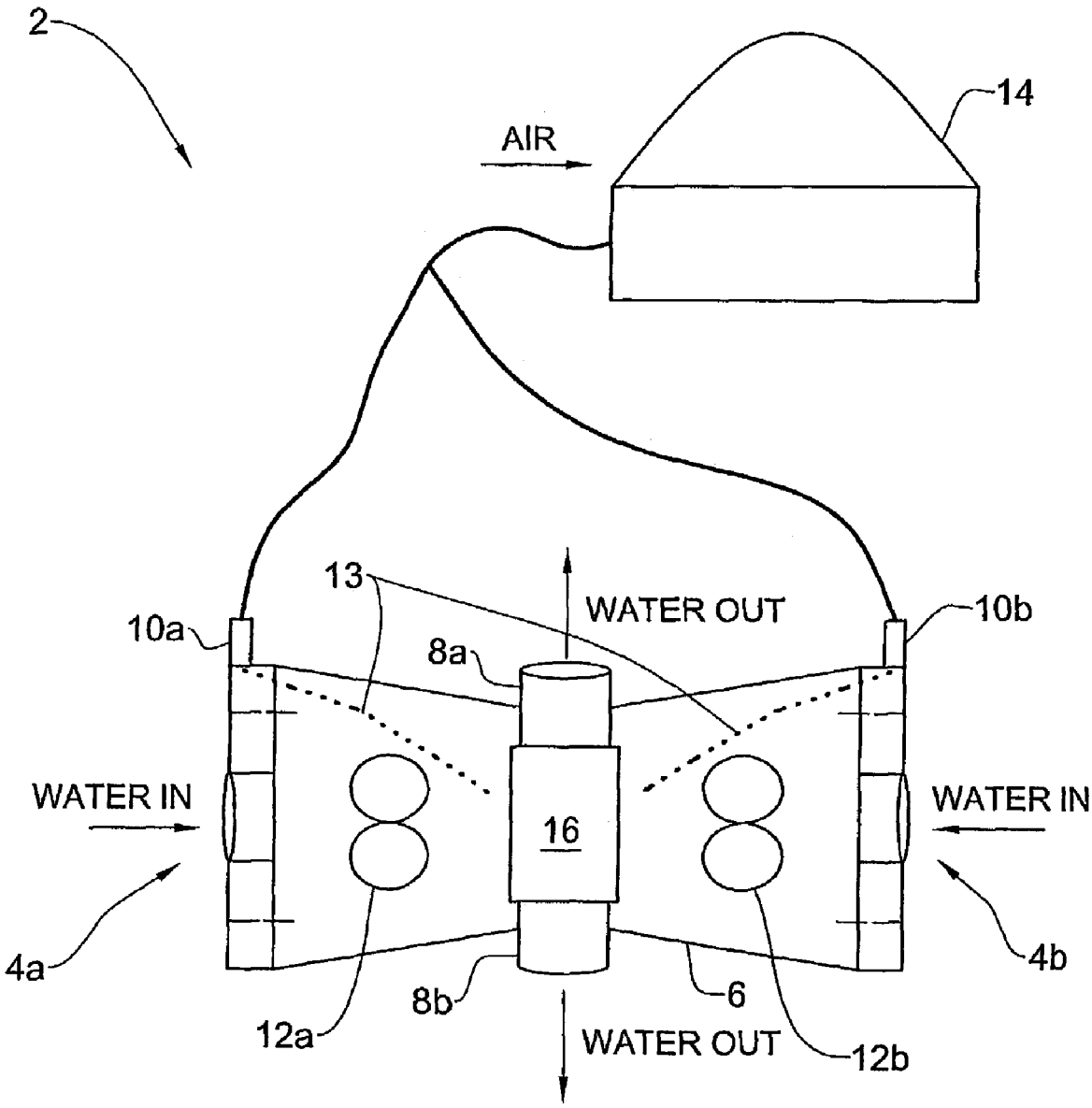
FIG. 1 shows an apparatus according to the present invention.

FIG. 1 schematically shows a self-contained breathing apparatus 2 according to the present invention. The apparatus 2 is adapted to provide breathable air and is designed for use within any body of water naturally containing dissolved air, such as an ocean, lake, pond, river and the like. As can be seen in FIG. 1, the apparatus 2 comprises two inlet means 4*a* and 4*b* for extracting a quantity of water from the body of water, but may have one or many such inlet means. The inlet means 4*a*, 4*b* may be any kind of conduit through which liquid can be conducted.

The apparatus 2 further comprises a separator 6 for separating the dissolved air from the extracted quantity of water conducted thereto via the inlet means 4*a* and 4*b*. The separator 6 has a housing and also includes first outlet means 8*a* and 8*b* for expelling the separated water back into the body of water, and second outlet means 10*a* and 10*b* for conducting the separated air out from the separator 6. The separator 6 may include one or many first and second outlet means, which may be any kind of conduit through which fluids can be conducted.

The second outlet means 10*a* and 10*b* may include valves that only permit air to be conducted further. These valves may be any kind of mechanism preventing the passage of water but allowing the passage of air. One possible option for such a mechanism includes providing a portion of the outlet means 10*a* and 10*b* that tapers to a smaller cross-sectional area and also includes a floating body, similar to a ping pong ball, for example, having a larger cross-sectional area and, consequently, being capable of blocking the movement of water without hindering the passage of air. Since the separated air in the separator 6 rises above the water, the separator 6 may be designed to ensure that the outlet means 10*a* and 10*b* and valves are located on the upper part of the separator 6. In addition, a plurality of outlets with valves can be positioned at various points on the separator 6, thereby ensuring that at least one of them is always pointing up and in contact with the rising separated air. In this way, the air rises towards the highest outlets 10*a*, 10*b*, which conduct the air further, either directly to a location for breathing or to an air bag 14, which serves as a storage reservoir for breathable air.

The air bag 14 may be any kind of storage reservoir, and may also be part of another body such as a floatation jacket or depth-adjusting bladder, thereby simultaneously serving multiple purposes.

The apparatus 2 further comprises a pump 16 to pump water into the separator 6 via the inlet means 4*a* and 4*b*. The pump 16 may be any mechanism creating a flow of water through the separator 6 such as by drawing water in via one or more of the inlet means 4*a* and 4*b* and/or ejecting water out via one or more of the outlet means 8*a* and 8*b*. The pump 16 is motorized and may be powered electrically, using batteries for example, or mechanically, such as by using the efforts of a user.

The apparatus 2 and method by which it functions can be employed in a variety of settings to provide breathable air to living beings such as in submersible quarters, e.g. submarines or underwater habitats, as well as in diving gear for use by individuals. The apparatus 2 may further be used to provide such breathable air for uses other than breathing, e.g. for supplying air to combustion engines.

Figure 2:
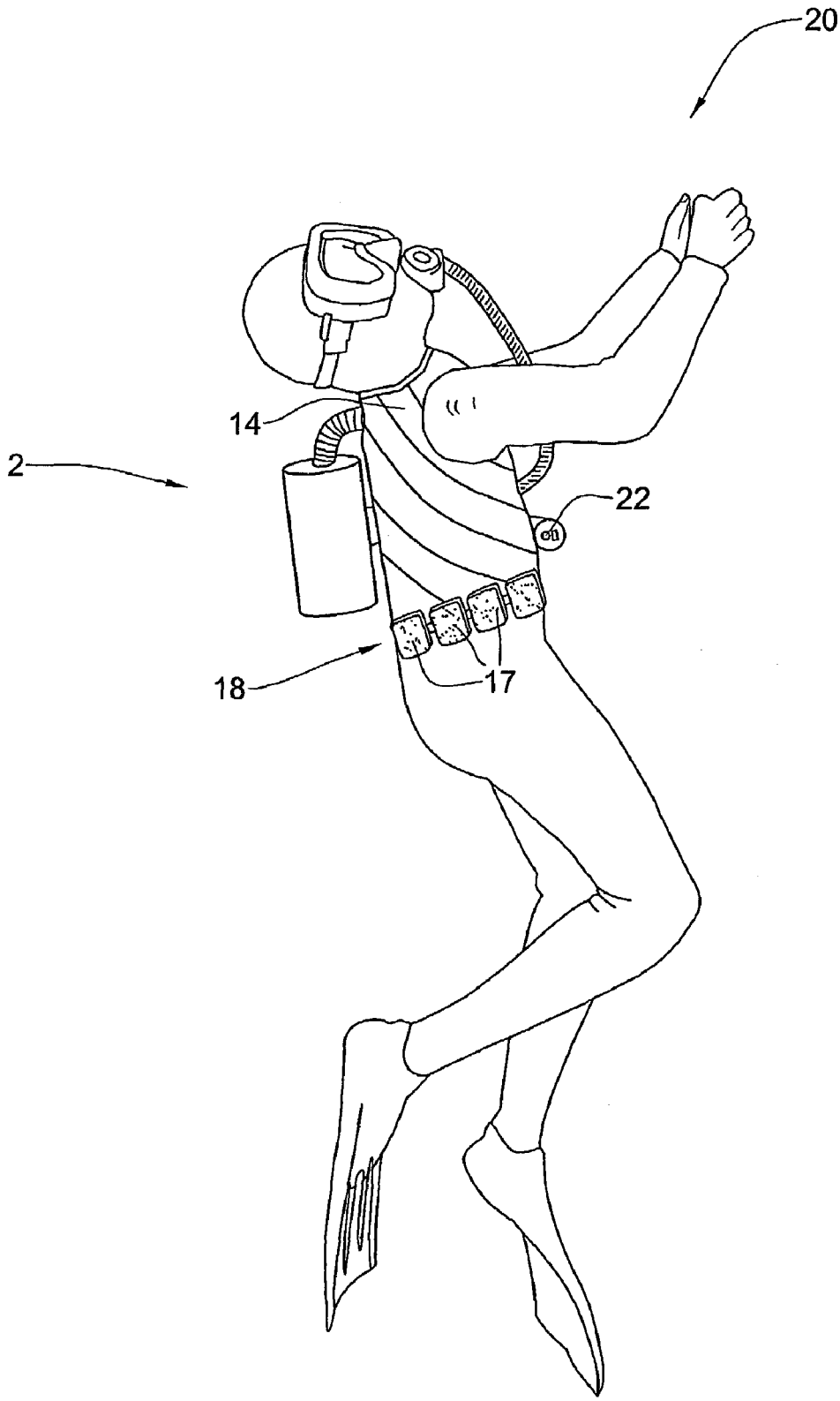
FIG. 2 shows an embodiment of an apparatus according to the present invention.

FIG. 2 illustrates a specific use of the apparatus 2 according to the present invention designed for an individual diver 20 as in the case of SCUBA. In this use, the apparatus 2 includes batteries 17 to supply electrical power thereto, which are arranged on a belt 18 worn by the diver 20. The belt 18 may also carry lead diving weights to provide the diver 20 with the additional weight needed to counter his natural buoyancy, or alternatively, the batteries may also provide or contribute to this needed weight. The diver 20 also wears the air bag 14, which simultaneously serves as a thermal and flotation jacket.

Figure 3:
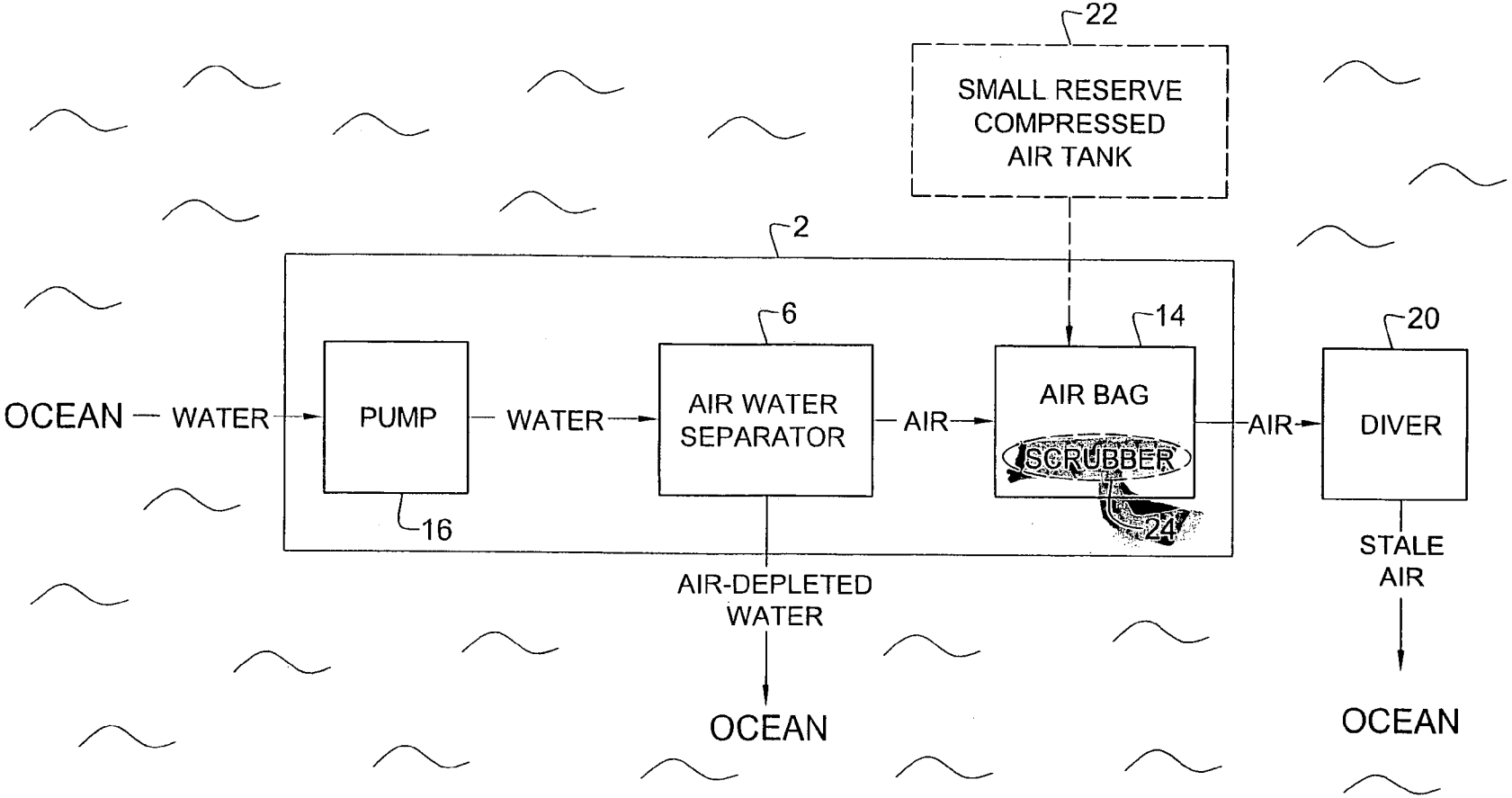
FIG. 3 is a functional diagram of the method by which the apparatus of FIG. 2 operates.

FIG. 3 is a functional diagram schematically illustrating how an apparatus 2 according to the present invention may operate for an individual diver in an ocean. Seawater from the ocean is drawn into the apparatus 2 via the inlet means (not shown) by the pump 16 and enters the separator 6.

The separator 6 separates the dissolved air from the water by any known method of physical separation or combination thereof. Most such methods are based on passing the water across a pressure drop and examples include, but are not limited to, cavitation, volumetric increase, and the use of centrifugal force. Cavitation involves passing the water across a hydrofoil such as a propeller, which, due to its design, creates a lower pressure region on its trailing edge, resulting in the release of dissolved air. Volumetric increase entails passing the water from a smaller to a larger space, thus increasing the volume of the water and decreasing the pressure applied thereto, thereby causing the release of the dissolved air. The use of centrifugal force involves rotating the water at such a speed that the heavier water moves farther away from the axis of rotation than the lighter dissolved air, consequently resulting in its separation.

The air-depleted seawater is expelled from the apparatus 2 back into the ocean via the first outlet means (not shown). The air released by separation is breathable and is, preferably, conducted to the air bag 14 via the second outlet means (not shown), wherefrom it is supplied to the diver. Having been breathed by the diver, the air is expelled into the ocean. If the diver requires less air than is conducted to the air bag 14 by the separator 6, the air bag 14 stores the air. When the air bag fills completely, the air separator 6 shuts down until the diver has used a predetermined fraction of the air in the bag 14, at which point the separator 4 resumes supplying air to the air bag 14. In this way, the apparatus expends less power. In the case of an individual diver, it is preferable for the air bag 14 to be flexible and inflatable but at the same time made from a durable material to minimize its likelihood of being damaged since the diver draws his breath from the air bag 14. In the case of a submarine or underwater habitat, a storage reservoir such as an air bag 14 may not be necessary and the breathable air can be directly supplied to such spaces.

Reverting back to FIG. 1, the separator 6 shown utilizes two propellers 12*a* and 12*b* to separate air from water by cavitation. The propellers 12*a* and 12*b* also contribute to separation by imparting a centrifugal force on the water. In addition, the propellers 12*a* and 12*b* drive the water through the separator 6, thereby acting as axial pumps, which may be used in place of or in conjunction with the pump 16. The separator 6 may also comprise air tubes 13 to attract rising bubbles of air as they are separated from the water and convey them to the outlets 10*a* and 10*b*. The air tubes 13 may be made of a material (e.g. stainless steel) adapted to attract air bubbles based on the coalescence effect.

The amount of breathing air required by a diver depends on many factors such as diving depth and extent of physical exertion and also varies from one individual to the next. Nonetheless, most divers, even during their highest exertion, require no more than 25 liters of air per minute, and so the separator 6 is designed to provide at least this minimum amount of air at this rate. While the apparatus 2 may be of various sizes, one possible example for use by an individual diver includes the apparatus 2 having separator 6 cylindrical in shape and approximately 10 inches in diameter at its base and 20 inches long. For a separator 6 having these dimensions and two cavitating propellers spanning its inner diameter, at most depths, the pump 16 will need to provide about 2000 liters of average seawater per minute to the separator 6 in order to produce the aforementioned minimum amount of air required by the diver.

As can be seen in FIGS. 2 and 3, the apparatus 2 according to the present invention may include a small reserve tank 22 of compressed breathable gases to be used in the case of a malfunction, which prevents or hinders the providing of air.

Also, as shown in FIG. 3, the apparatus 2 may include an air purifying mechanism, such as a scrubber 24, as known in the art, adapted to reduce the amount of carbon dioxide and/or other undesirable gases present within the air bag 14 and to thereby enable delivery of a more healthy supply of breathable air to the diver 20.

Reverting to FIG. 1, the apparatus 2 may also provide a diver or other submersible with propulsion by directing the flow of water via the first outlet means 8*a* and 8*b* in a desired manner. Provided with a means for varying their direction separately or in unison, the first outlet means 8*a* and 8*b* can be oriented to create thrust at a user's command and propel the diver or submersible in a desired direction. In this way, energy that would otherwise be expended to propel a diver or submersible is saved.

It should be understood that the above described embodiments are only examples of a self-contained open-circuit underwater breathing apparatus and method for using same according to the present invention, and that the scope of the present invention fully encompasses other embodiments which may become obvious to those skilled in the art. For example, the apparatus may be used in underwater drilling, where a supply of air may be necessary.

The invention claimed is:

1. A self-contained open-circuit breathing apparatus for use within a body of water naturally containing dissolved air, adapted to provide breathable air to a diver, the apparatus comprising an inlet-means for extracting a quantity of water from said body of water, a separator for separating-said dissolved air from said quantity of water, thereby obtaining said breathable air, a first outlet means for expelling the separated water back into said body of water, and a second outlet means for removing said breathable air and supplying it for breathing so as to enable all of the air, after it has been breathed, to be expelled back into the body of water.

2. An apparatus according to claim 1, wherein said first outlet means are oriented so as to provide means of propulsion.

3. An apparatus according to claim 1, wherein the separator is adapted to be powered by the diver's physical effort.

4. An apparatus according to claim 1, further including batteries to provide a power source.

5. An apparatus according to claim 4, wherein the batteries provide weight to counter the diver's buoyancy.

6. An apparatus according to claim 1, further including an air bag to which the breathable air is transferred for storage.

7. An apparatus according to claim 6, wherein the air bag is adapted to additionally serve as a flotation device for the diver.

8. An apparatus according to claim 6, wherein the air bag is adapted to additionally serve as a depth-adjusting bladder.

9. An apparatus according to claim 1, further comprising a tank of compressed breathable gases as a safety measure.

10. An apparatus according to claim 1, further comprising a pump for creating a flow of water into the apparatus through said inlet means.

11. An apparatus according to claim 10, wherein the pump is adapted to create a flux of water into the apparatus of at least 2000 liters of water per minute.

12. An apparatus according to claim 1, wherein the separator is adapted to separate at least 25 liters of breathable air per minute.

13. An apparatus according to claim 1, wherein the separator is adapted to separate by passing said quantity of water across a pressure drop.

14. An apparatus according to claim 13, wherein said separator is adapted to separate by one of the following: cavitation, volumetric increase, centrifugal force.

15. An apparatus according to claim 1, wherein the separator is adapted to separate by coalescence.

16. An apparatus according to claim 1, wherein the apparatus is adapted to eject said expelled air in the form of bubbles.

17. An apparatus according to claim 1, wherein the first outlet means is adapted to directly expel all of the separated water back into said body of water.

18. An apparatus according to claim 1, further comprising an air purifying mechanism adapted to reduce undesirable gases present within said breathable air.

19. A self-contained open-circuit breathing apparatus for use within a body of water naturally containing dissolved air, adapted to provide breathable air to a diver, the apparatus comprising an inlet means for extracting a quantity of water from said body of water, a separator for separating said dissolved air from said quantity of water, thereby obtaining said breathable air, a first outlet means for expelling the separated water back into said body of water, and a second outlet means for removing said breathable air and supplying it for breathing so as to enable all of the air, after it has been breathed, to be expelled back into the body of water, further including an air bag to which the breathable air is transferred for storage, wherein the separator is adapted to shut down when the air bag fills to a predetermined extent and reactivates when the air bag empties to a predetermined extent.

20. A method for providing breathable air to a diver from a body of water naturally containing dissolved air comprising the steps of:

drawing a quantity of water from said body of water;

separating said dissolved air from the drawn quantity of water;

expelling the separated quantity of water and supplying the separated air for breathing;

expelling all of the air back into said body of water after it has been breathed.

21. An apparatus according to claim 20, wherein the body of water is one of the following: ocean, lake, pond and river.

22. An apparatus according to claim 20, wherein the method is powered by the diver's physical effort.

23. An apparatus according to claim 20, further including the step of storing said separated air for breathing before supplying it for breathing.

24. An apparatus according to claim 20, wherein said drawing is performed by a pump.

25. An apparatus according to claim 20, wherein said separating is performed by passing said quantity of water across a pressure drop.

26. An apparatus according to claim 25, wherein said separating is achieved by one of the following: cavitation, volumetric increase, centrifugal force.

27. An apparatus according to claim 20, wherein the separator is adapted to separate by coalescence.

28. An apparatus according to claim 20, wherein said expelling of the air produces bubbles.

29. An apparatus according to claim 20, wherein said separated air is purified before being supplied for breathing.

30. An apparatus according to claim 1, wherein the first outlet means is adapted to directly expel all of the separated water back into said body of water.

31. A method for providing breathable air to a diver from a body of water naturally containing dissolved air comprising the steps of:

drawing a quantity of water from said body of water;

separating said dissolved air from the drawn quantity of water;

expelling the separated quantity of water and supplying the separated air for breathing;

expelling all of the air back into said body of water after it has been breathed, wherein said expelling of the separated water serves to propel the diver.

32. A self-contained breathing apparatus for use within a body of water naturally containing dissolved air, adapted to provide breathable air, the apparatus comprising an inlet means for extracting a quantity of water from said body of water, a separator for separating said dissolved air from said quantity of water by passing said quantity across a pressure drop, thereby obtaining said breathable air, a first outlet means for expelling the separated water back into said body of water, and a second outlet means for removing said breathable air and supplying it for breathing so as to enable the air, after it has been breathed, to be expelled back into the body of water.

33. An apparatus according to claim 32, wherein said separator is adapted to separate by one of the following: cavitation, volumetric increase, centrifugal force.

34. An apparatus according to claim 32, wherein the apparatus is adapted to eject said expelled air in the form of bubbles.

35. An apparatus according to claim 32, wherein the first outlet means is adapted to directly expel all of the separated water back into said body of water.

36. An apparatus according to claim 32, adapted for supplying breathable air to submersible quarters.

37. An apparatus according to claim 32, adapted for supplying breathable air to a diver.

38. An apparatus according to claim 32, wherein the body of water is one of the following: ocean, lake, pond and river.

39. An apparatus according to claim 32, wherein the apparatus is adapted to be open-circuit to expel all of the air, after it has been breathed, into the body of water.

40. An apparatus according to claim 32, wherein said first outlet means are oriented so as to provide means of propulsion.

41. An apparatus according to claim 32, wherein the separator is adapted to be powered by the diver's physical effort.

42. An apparatus according to claim 32, further including batteries to provide a power source.

43. An apparatus according to claim 42, wherein the batteries provide weight to counter the diver's buoyancy.

44. An apparatus according to claim 32, further including an air bag to which the breathable air is transferred for storage.

45. An apparatus according to claim 44, wherein the separator is adapted to shut down when the air bag fills to a predetermined extent and reactivates when the air bag empties to a predetermined extent.

46. An apparatus according to claim 44, wherein the air bag is adapted to additionally serve as a flotation device for the diver.

47. An apparatus according to claim 44, wherein the air bag is adapted to additionally serve as a depth-adjusting bladder.

48. An apparatus according to claim 32, further comprising a tank of compressed breathable gases as a safety measure.

49. An apparatus according to claim 32, further comprising a pump for creating a flow of water into the apparatus through said inlet means.

50. An apparatus according to claim 49, wherein the pump is adapted to create a flux of water into the apparatus of at least 2000 liters of water per minute.

51. An apparatus according to claim 32, wherein the separator is adapted to separate at least 25 liters of breathable air per minute.

52. An apparatus according to claim 32, wherein said breathable air is supplied to a combustion engine.

* * * * *